United States Patent [19]

Choi

[11] 4,070,250

[45] Jan. 24, 1978

[54] PYROLYSIS OF CARBONACEOUS MATERIALS IN A DOUBLE HELIX CYCLONE

[75] Inventor: Charles K. Choi, Claremont, Calif.

[73] Assignee: Occidental Petroleum Corporation, Los Angeles, Calif.

[21] Appl. No.: 700,001

[22] Filed: June 25, 1976

[51] Int. Cl.[2] ..... B01D 45/12; C10B 1/00; C10B 49/16; C10G 1/00

[52] U.S. Cl. ..... 201/12; 48/111; 48/209; 48/210; 55/419; 55/459 B; 201/22; 201/23; 201/25; 201/28; 201/33; 202/99; 202/121; 208/8; 208/11 R

[58] Field of Search ..... 201/2, 5, 8, 10, 12, 201/22, 23, 25, 28, 38, 42, 33; 55/419, 459 R, 459 B; 209/144; 208/8, 11 R; 202/84, 85, 99, 108; 48/210, 209, 111, 77, 101

[56] References Cited

U.S. PATENT DOCUMENTS

| | | | |
|---|---|---|---|
| 1,432,170 | 10/1922 | Fenton | 208/8 X |
| 1,954,352 | 4/1934 | Dornbrook et al. | 55/459 R X |
| 2,655,443 | 10/1953 | Moore | 48/206 |
| 2,689,786 | 9/1954 | Hubmann | 48/210 X |
| 2,707,444 | 5/1955 | Van Loon | 110/28 F |
| 2,739,104 | 3/1956 | Galbreath et al. | 201/33 X |
| 2,767,840 | 10/1956 | Dobson et al. | 55/459 R X |
| 2,848,381 | 8/1958 | Nicholson | 55/459 R X |
| 3,064,811 | 11/1962 | Mumper | 55/459 R X |
| 3,541,003 | 11/1970 | Carr et al. | 423/659 X |
| 3,655,518 | 4/1972 | Schmalfeld et al. | 202/108 |
| 3,853,498 | 12/1974 | Bailie | 201/12 X |

*Primary Examiner*—Joseph Scovronek
*Attorney, Agent, or Firm*—Christie, Parker & Hale

[57] ABSTRACT

Solid carbonaceous materials are pyrolyzed by introducing a low velocity stream of carbonaceous material into a cyclone reactor-separator and introducing a low velocity stream of a particulate source of heat into the cyclone reactor-separator at an angle inclined toward the path of travel of the carbonaceous material. A high velocity stream of the particulate source of heat is introduced into the cyclone reactor separator along the inner surface of the separator to prevent carbonaceous material from caking along the walls of the separator. The cyclone reactor separator induces separation of solids consisting of a particulate carbon containing solid residue of pyrolysis and particulate heat source from a vapor stream which contains hydrocarbon products of pyrolysis.

23 Claims, 3 Drawing Figures

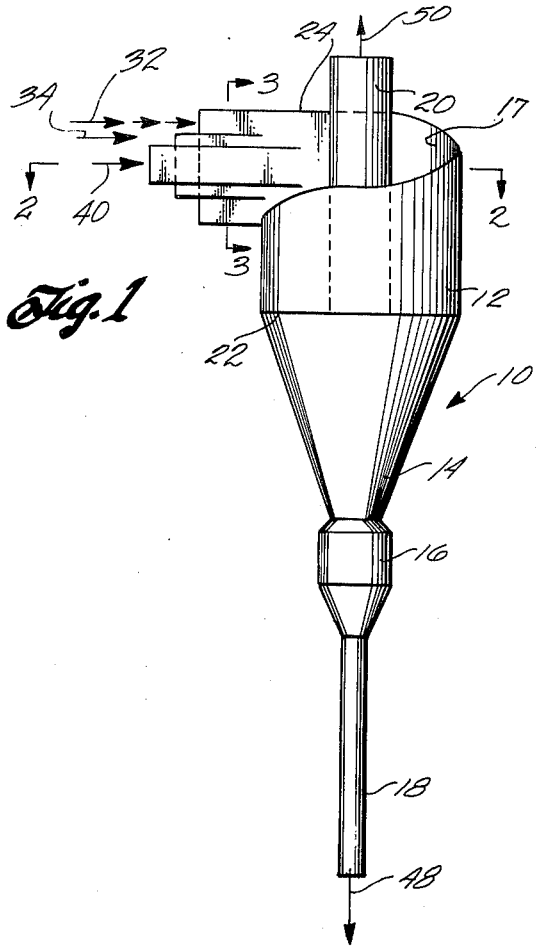
Fig. 1
Fig. 2
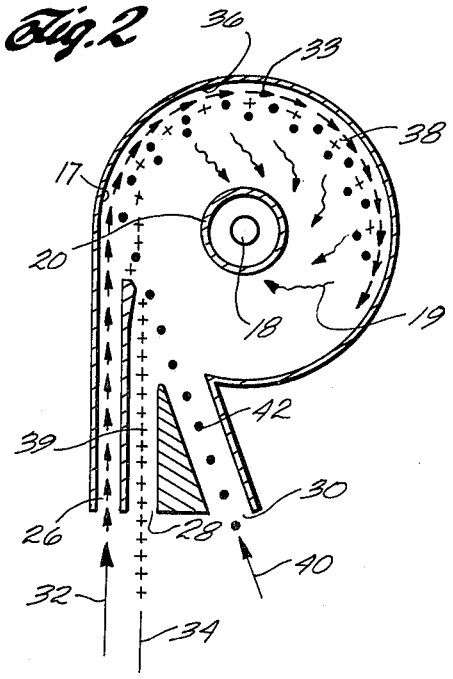
Fig. 3
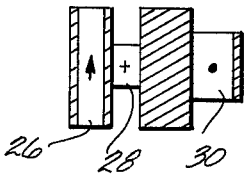

PYROLYSIS OF CARBONACEOUS MATERIALS IN A DOUBLE HELIX CYCLONE

BACKGROUND OF THE INVENTION

Due to increasing scarcity of fluid fossil fuels such as oil and natural gas, much attention is being directed towards converting solid carbonaceous materials such as coal, oil shale, and solid waste to liquid and gaseous hydrocarbons by pyrolyzing the solid carbonaceous material. Typically, pyrolysis occurs under nonoxidizing conditions in the presence of a particulate source of heat.

In the past, pyrolysis has been carried out in reactors with long pyrolysis time. The hydrocarbon product of reactors having a long pyrolysis time has been less than desired. This has been attributed to protracted effective pyrolysis times which result in thermal cracking of hydrocarbon product.

Use of tubular reactors providing a short pyrolysis time results in less thermal cracking. However a disadvantage of using a tubular reactor for pyrolysis is the caking or agglomeration problem. Experience with agglomerative coals, particularly Eastern United States coals, indicates that these coals pass through a "tacky" stage during which the coal particles have a tendency to agglomerate in some types of tubular reactors, especially along the walls of the reactor.

A need exists therefore for a more efficient pyrolysis process and a more efficient pyrolysis reactor which minimize pyrolysis time and which prevent coal from agglomerating along the walls of the reactor.

SUMMARY OF THE INVENTION

According to the present invention there is provided a process for the pyrolysis of solid carbonaceous materials and an apparatus used therefore with the above features.

In the process of this invention, a high velocity, high temperature stream of a particulate solid source of heat is introduced essentially tangentially to and passed along a path formed by the curved inner surface of a cyclone reaction-separation zone having a vapor outlet at one end and a solids outlet at the opposed base thereof. Simultaneously, a low velocity stream of solid carbonaceous material is introduced into the cyclone reaction-separation zone at an angle substantially parallel to the flow path of the high velocity stream of the particulate source of heat. The high velocity stream serves to prevent the carbonaceous material from contacting and agglomerating on the inner surface of the cyclone reaction-separation zone. Simultaneously with the introduction of these two streams there is introduced to the cyclone reaction-separation zone a low velocity, high temperature stream of particulate solid source of heat at an angle inclined toward the path of travel of carbonaceous material. This low velocity stream of the particulate source of heat penetrates and initiates pyrolysis of the carbonaceous material. The quantity of the particulate solid source of heat introduced in the low and high velocity streams is sufficient to raise the carbonaceous material to a pyrolysis temperature of at least about 600° F.

The pyrolysis of the carbonaceous material yields a particulate carbon containing solid residue and a pyrolytic vapor containing hydrocarbons.

There simultaneously occurs with the pyrolysis of the carbonaceous material a separation between a gaseous stream containing the pyrolytic vapor and a solids mixture of the particulate source of heat and carbon containing solid residue by the action of centrifugal force. All three streams are introduced with sufficient velocity to effect this separation by centrifugal action. This results in separate flow patterns for the gaseous stream and the solids mixture, and termination of the principal pyrolysis reactions.

In the process of this invention pyrolysis can occur at a temperature from about 600° to about 2000° F. Short reaction times and low temperatures in the cyclone separation zone enhance formation of middle distillate hydrocarbons, i.e., hydrocarbons in the range of $C_5$ hydrocarbons to hydrocarbons having an end point of 950° F. As a consequence, it is preferred to conduct pyrolysis at a temperature from about 900° to about 1400° F, and at pyrolysis times of less than about 3 seconds, and more preferably less than about 1 second.

To achieve pyrolysis the solid particulate source of heat generally is introduced at a temperature from about 100° to about 500° F higher than the pyrolysis temperature to be achieved. The weight ratio of the total particulate source of heat introduced to the cyclone reaction-separation zone to the carbonaceous feed ranges from about 2 to about 20. The distribution of the particulate source of heat between the low and high velocity streams is determined by the competing considerations of providing sufficient material in the high velocity stream to keep the carbonaceous material away from the reactor walls and providing sufficient material in the low velocity stream to heat the carbonaceous material to the desired pyrolysis temperature. Preferably, from about 10 to about 50% by weight of the particulate source of heat is in the high velocity stream, and more preferably from about 20 to about 30% by weight.

To achieve pyrolysis and proper separation, generally the feed velocities of the carbonaceous material and the low velocity stream of the particulate source of heat range from about 100 to about 200 feet per second.

To maintain a layer of the nonagglomerating particulate source of heat along the cyclone reaction separation zone walls, the high velocity stream of the particulate source of heat is maintained at a velocity greater than about 200 feet per second. To prevent erosion of the walls, the velocity of the high velocity stream preferably is less than 250 feet per second. Generally, the low velocity stream of the particulate source of heat is introduced at an angle of at least about 15° relative to the path of travel of the carbonaceous material to ensure intimate mixing between the carbonaceous material and the low velocity stream of the particulate source of heat. To prevent the low velocity stream of the particulate source of heat from carrying carbonaceous material up against the inner surface of the cyclone reaction separation zone, the particulate solid source of heat preferably is introduced at an angle of less than about 40°, and more preferably less than about 25° relative to the path of travel of the carbonaceous material.

The apparatus employed to carry out the process of this invention comprises a high temperature cyclone separator reactor having a first feed inlet for tangentially introducing a high velocity stream of the particulate source of heat. There is a second feed inlet for the low velocity stream of carbonaceous material. This second inlet defines a flow path essentially parallel to the flow path defined by the first inlet. There is a third feed inlet for the low velocity stream of the particulate source of heat. The third feed inlet is inclined at an angle of from about 15° to about 40° toward the first and second inlets and preferably at an angle from about 15° to about 25°. The cyclone separator reactor has a vapor exhaust at one end for removal of vaporized products of pyrolysis and a solids outlet at the opposed end for removal of the particulate solid source of heat and carbon containing solid products of pyrolysis.

This process and reactor resolve the problems associated with prior art reactors discussed above. Because the coal feed and hot solid particles are injected directly into a cyclone reactor in which heat transfer, the pyrolysis reaction and separation all take place within a very short period of time, less thermal cracking of the hydrocarbon product results. In addition, because of the fast velocity of the stream of the particulate source of heat injected along the reactor walls, these particles have greater centrifugal force than the carbonaceous material and therefore form an outer layer along the walls which prevents coal particles agglomeration on the wall.

These and other features, aspects and advantages of the present invention will become more apparent with reference to the following drawings, detailed description of the invention, and appended claims.

DRAWINGS

FIG. 1 is an elevation view in partial section of the cyclone reactor separator embodying features of this invention;

FIG. 2 is a top view of the cyclone reactor-separator of FIG. 1 along aline 2—2 of FIG. 1; and FIG. 3 is a view in cross section of the cyclone reactor inlet region along line 3—3 in FIG. 1.

DESCRIPTION OF THE INVENTION

According to the present invention there is provided a process and apparatus for the pyrolysis of solid carbonaceous material which can be used at extremely short pyrolysis contact times and to prevent agglomeration of the carbonaceous material.

The solid carbonaceous materials which are pyrolyzed in accordance with the present invention include tar sands, oil shale, the organic portion of solid waste, nonagglomerative and especially agglomerative coals, and the like, as well as mixtures thereof.

Referring to the FIGS., a cyclone reactor-separator 10 consists of a vertically oriented cyclindrical body 12 merging into a conical section 14 below and axially aligned with the main body 12. Below the conical section there is a reservoir 16, which feeds a dipleg 18 serving as a solids outlet. A vapor exhaust conduit 20 which preferably is coaxial with the main body, extends from the bottom 22 out through the top 24 of the cylindrical main body section.

There are provided three side-by-side inlets to the top portion of the main body section. These include a first feed inlet 26 tangential to the cyclone reactor-separator wall 17 for a high velocity stream of a particulate source of heat and an adjacent second feed inlet 28 to the cyclone reactor-separator walls for a low velocity stream of carbonaceous material. The second feed inlet defines a flow path parallel to the flow path defined by the first inlet. There is also provided a third feed inlet 30 for a low velocity stream of the particulate source of heat. This inlet is inclined at an angle toward the first and second tangential feed inlets.

A particulate solid source of heat is injected as stream 32 into the cyclone reaction separation zone 10 tangentially to the walls thereof through the first inlet 26. The velocity of the stream 32 preferably is normally greater than about 200 feet per second so that the hot particles have sufficient momentum to travel along the inner wall of the cyclone reactor-separator along the path marked by the arrows 33 in FIG. 2. The velocity of this stream preferably is less than about 250 feet per second so that the particles do not erode the inner wall 36 of the cyclone reactor-separator.

Simultaneously with the introduction of the high velocity stream, there is introduced a low velocity stream 34 containing the carbonaceous material, and if necessary a carrier gas. The carrier gas, if employed, is non-deleteriously reactive with respect to the products of pyrolysis, and serves as a diluent to minimize pyrolysis contact time and to dilute the carbonaceous material to prevent self-agglomeration. As used herein, by "non-deleteriously reactive" gas, there is meant a gas which is essentially free of free oxygen. Although constituents of the gas may react with pyrolysis products to upgrade their value, to be avoided are constituents which degrade the pyrolysis product. The carrier gas may, for instance, be the off gas product of pyrolysis, steam, which reacts under suitable conditions with char or coke formed from pyrolysis to yield by a water-gas shift reaction hydrogen which serves to react with and stabilize unsaturates in the products of pyrolysis, any desired inert gas or mixtures thereof.

The carbonaceous material is introduced at an angle substantially parallel to the path followed by the high velocity stream 32 of the particulate source of heat when it is introduced into the cyclone. The velocity of the carbonaceous material is less than the velocity of the high velocity particulate source of heat, and normally up to about 200 feet per second. This ensures that the carbonaceous material is separated from the inner surface 36 of the cyclone reaction-separation zone by the higher velocity layer of the nonagglomerating particulate source of heat. This occurs because the high velocity stream has greater momentum and thereby preferentially travels along the inner wall 36 of the cylone reactor. The carbonaceous material preferably has a velocity of at least 100 feet per second so that sufficient centrifugal forces are induced in the cyclone reactor-separator to effect a separation of the gaseous products of pyrolysis and the carrier gas from the solid products of pyrolysis and the particulate source of heat.

The carbonaceous material travels along the flow path 38 marked by "+" signs 39 shown in FIG. 2. This path is closer to the central vertical axis than is the flow path 33 of the high velocity stream 32 of the particulate source of heat.

The carbonaceous material may be treated before it is fed to the cyclone reaction separation zone by processes such as removal of inorganic fractions by magnetic separation and classification, particularly in the case of municipal solid waste. The carbonaceous material also can be dried to reduce its moisture content. The solid carbonaceous material usually is comminuted to increase the surface area available for the pyrolysis reaction.

Simultaneously with the introduction of the carbonaceous material and the low velocity stream of the particulate source of heat, a low velocity, high temperature stream 40 of the particulate source of heat is introduced into the cyclone reactor-separator 10 through the third inlet 30 which is adjacent to the inlet 28 for the carbonaceous material and inclined at an angle toward the path of travel 38 of the carbonaceous material.

Both the low velocity and the high velocity streams of the particulate source of heat may be transported into the pyrolysis reactor by a carrier gas nondeleteriously reactive with respect to pyrolysis product. The gas may be the same or different from the gas carrying the carbonaceous feed into the pyrolysis reactor, although this carrier gas would preferably be at a temperature approximately equal to the temperature of the particulate solid source of heat.

Because the low velocity particulate solid source of heat enters the pyrolysis reactor 10 at an angle inclined to the path 38 of travel of the carbonaceous material, it penetrates the path of the carbonaceous material as shown by dotted line 42 in FIG. 2. This penetration initiates heat transfer from the particulate solid source of heat to the carbonaceous material, causing pyrolysis which is a combination of vaporization and cracking reactions. As the vaporizations and cracking reactions occur, condensible and noncondensible hydrocarbons are generated from the carbonaceous material with an attendant production of a carbon containing solid residue such as coke or char. The carbon containing solid residue and the particulate source of heat being the heaviest materials present are retained and pass spirally along the walls of the cyclindrical main body 12 and cone section 14 of the cyclone reactor-separator 10, pass through the reservoir 16, and are discharged through the dipleg outlet 18. The carrier gas as well as the pyrolytic vapors separate in spiral vortex flow towards the center of the cyclone reactor-separator 10 as shown by line 19 in FIG. 2, and rapidly terminate the primary pyrolysis reactions due to the absence of solids. Effective pyrolysis time will be less than about 3 seconds and preferably less than about 1 second to prevent excessive cracking of the hydrocarbon product. Residence times as low as 0.01 second are desirable in the pyrolysis reactor to increase yields of valuable alkenes such as propene and butene.

As used herein, the term "pyrolysis time" refers to the time from when the carbonaceous material first contacts the particulate source of heat until when the hydrocarbon product is separated from the particulate source of heat. A convenient measure of pyrolysis time is the average residence time of the carrier gas in the cyclone reactor-separator.

The lower limit on pyrolysis time is the time required to heat the carbonaceous material to the pyrolysis temperature. This depends on the particle size of the carbonaceous material with larger diameter particles taking longer to heat. For example, it takes about 1.5 seconds to completely heat a feed stream containing particles of 250° microns in diameter to 1075° F in a reactor as shown in the Drawings, while it takes only about 0.5 seconds for a feed stream containing particles up to 75 microns in diameter.

The hot particulate solids in the low 32 and high 40 velocity streams are supplied at a rate and a temperature consonant with maintaining a temperature in the cyclone reactor-separator 10 suitable for pyrolysis. Pyrolysis initiates at about 600° F and may be carried out up to temperatures above 2000° F. Pyrolysis is conducted at a temperature from about 600 to about 1600° F, and more preferably 900° to 1400° F to maximize the yield of middle boiling point hydrocarbons. Higher temperatures by contrast enhance gasification reactions.

The maximum pyrolysis temperature is limited to the temperature at which the inorganic portion of the carbonaceous feed or particulate source of heat softens, with resultant fusion or slag formation.

Depending upon pyrolysis temperature, normally from about 2 to about 20 pounds of particulate solid source of heat are fed per pound of carbonaceous material entering reactor 10. The solids employed may be solids provided external to the process such as sand or the solid product resulting from pyrolysis of the carbonaceous material such as char or coke or in the instance of municipal solid waste, the glass-like inorganic residue resulting from the decarbonization of the solid residue of pyrolysis. At these weight ratios, the particulate source of heat is at a temperature from about 100° to about 500° F or more above the desired pyrolysis temperature. The particulate source of heat serves to prevent agglomeration of the carbonaceous material and to provide the heat required for the endothermic pyrolysis reaction The amount of gas employed to transport the solid carbonaceous material and the particulate source of heat is sufficient to maintain transport of the materials and avoid plugging and normally in excess of that amount of dilute the carbonaceous materials and prevent self-agglomeration. Normally, the weight ratio of carbonaceous materials plus particulate source of heat to gas is from about 1 to about 4 or more.

The low velocity stream of the particulate source of heat preferably has a velocity the same as that of the carbonaceous material, i.e., from about 100 to about 200 feet per second. If its velocity is greater than about 200 feet per second, the low velocity particulate source of heat tends to carry a portion of the carbonaceous material up against the walls of the cyclone reactor separator, and this may lead to caking. At velocities less than about 100 feet per second, there is insufficient momentum to effect a good separation of vapors from solids in the cyclone reactor.

Although the stream of carbonaceous material 34 and the particulate source of heat 40 introduced through the second 28 and third 30 inlets, respectively, have been described as "low velocity", what is meant is that their velocity is low as compared to the high velocity stream 32 of the particulate source of heat introduced through the first inlet 26. The preferred minimum speed for streams 34 and 40 is about 100 feet per second.

The distribution of the particulate source of heat between the high 32 and low 40 velocity streams is a balance between two competing considerations. First, if less than about 10% of the particulate source of heat is used in the high velocity stream, an inadequate layer of hot nonagglomerative particles is formed along the reactor inner wall 36 and thus carbonaceous material can agglomerate along the walls. Therefore it is preferred that at least 10% of the particulate source of heat be contained in the high velocity stream 32.

The second consideration is the necessity of providing a sufficient amount of the particulate source of heat in the low velocity stream 32 to raise the temperature of the carbonaceous material to the desired pyrolysis temperature. Only a limited amount of heat is transferred from the high velocity stream to the carbonaceous material, and this is primarily due to heat transfer by convection and radiation. Therefore, preferably at least 50% of the particulate source of heat is included in the low velocity stream, and more preferably from about 70 to about 80%.

The solids mixture 48 discharged from the bottom outlet 18 of the cyclone reactor-separator 10 contains particulate solid source of heat and the carbon containing solids residue. The solids residue may be used as the particulate source of heat by at least partially oxidizing it in the presence of a source of oxygen such as air and cycling it back to the pyrolysis reactor 10.

The gas stream 50 exiting the top outlet 12 from the pyrolysis reactor 10 contains pyrolytic vapors comprising hydrocarbons, carrier gases, and undesirable components such as hydrogen sulfide which may be generated in the pyrolysis reaction. The volatilized hydrocarbons produced by pyrolysis consist of condensible hydrocarbons which may be recovered by simply contacting the volatilized hydrocarbons with condensation means, and noncondensible hydrocarbons such as methane and other hydrocarbon gases which are not recoverable by ordinary condensation means. Condensible volatilized hydrocarbons can be separated and recovered by conventional separation recovery means such as venturi scrubbers, indirect heat exchangers, wash towers, and the like. The undesirable gaseous products can be removed from the uncondensible hydrocarbons by conventional means such as chemical scrubbing. Remaining uncondensed hydrocarbons can be sold as a product gas stream and can be utilized as the carrier gas for carrying the carbonaceous material and the particulate source of heat to the pyrolysis reaction-separation zone 10.

The process and apparatus of this invention are particularly useful for agglomerative coals because caking of the coal along the reactor walls is prevented by the fast moving hot solid particles. In addition, because there is rapid and thorough mixing between the feed coal and the large amount of hot heat carrier particles in the low velocity stream, there is less tendency of coal particles to self-agglomerate. Also, the coal particles are always traveling in the midst of a stream of hot heat carrier particles having a velocity of from 100 to 200 feet per second. These heat carrier particles have abundant kinetic energy to help prevent agglomeration of the coal particles. Furthermore, this invention results in high yields of valuable hydrocarbons from coal because of the short pyrolysis time in the cyclone.

Although the process and apparatus of this invention are described in terms of certain embodiments thereof, other embodiments of this invention are obvious to those skilled in the art. For example, hydrogen gas can be added to the pyrolysis reactor-separator to hydrogenate the volatilized hydrocarbons resulting from the pyrolysis of the carbonaceous material to upgrade their value.

Also, although the high velocity stream 32 of the particulate source of heat has been described as being introduced essentially tangentially into the cyclone reactor-separator, it is possible to introduce this stream inclined at an angle relative to the wall of the cyclone. However, if the high velocity stream 32 is introduced inclined toward the cyclone walls, increased erosion of the cyclone results, and if it is introduced inclined away from the cyclone walls, it tends to do a poorer job of keeping carbonaceous material away from the walls of the cyclone. Similarly, the stream 34 of carbonaceous material does not have to be introduced substantially parallel to stream 32. However, it is undesirable to introduce the carbonaceous material inclined towards the walls of the cyclone since this increases the chance of carbonaceous material caking on the wall. If the carbonaceous material is inclined towards the center of the cyclone, this results in greater penetration of the carbonaceous material by the low velocity stream of the particulate source of heat with potentially better heat transfer between these two streams.

Because of variations such as these, the spirit and scope of the appended claims should not necessarily be limited to the description of the versions described above.

What is claimed is:

1. In a process for the pyrolysis of carbonaceous materials in which the carbonaceous material is primarily pyrolyzed by heat transferred thereto from a high temperature particulate solid source of heat to yield as products of pyrolysis, a pyrolytic vapor containing hydrocarbons and a particulate carbon containing solid residue, the improved method of achieving pyrolysis which comprises the steps of:

a. essentially tangentially introducing to and passing along a path formed by the curved inner surface of a cyclone reaction-separation zone having a vapor outlet at one end and a solids outlet at the base thereof, a high velocity, high temperature stream of the particulate solid source of heat, while;

b. introducing to the cylone reaction-separation zone a low velocity stream of carbonaceous material in a flow path essentially parallel to the flow path of the high velocity stream of the particulate solid source of heat, wherein the high velocity stream of the particulate solid source of heat serves to prevent carbonaceous material from contacting and agglomerating on the inner surface of the cyclone reaction-separation zone, while;

c. introducing to the cyclone reaction-separation zone into at least the entering path of the low velocity stream of carbonaceous material, a low velocity, high temperature stream of the particulate solid source of heat an an angle inclined toward the path of travel of carbonaceous material to penetrate and initiate pyrolysis of the carbonaceous material, the introduced quantity of particulate source of heat in the low velocity and high velocity of streams of particulate solid source of heat being sufficient to raise the carbonaceous material to a pyrolysis temperature of at least about 600° F; and d. separating a gaseous stream containing the pyrolytic vapor from a solids mixture including the particulate solid source of heat and the carbon containing solid residue by the formation of flow patterns of each by action of induced centrifugal forces.

2. A process as claimed in claim 1 in which the pyrolysis time is less than about 3 seconds.

3. A process as claimed in claim 1 in which the pyrolysis time is less than about 1 second.

4. The process of claim 1 in which the pyrolysis temperature is from 900° to about 1400° F.

5. The process of claim 1 in which the weight ratio of the particulate solid source of heat to carbonaceous material is from about 2 to about 20.

6. The process of claim 5 in which from about 10 to about 50% by weight of the particulate solid source of heat is in the high velocity stream.

7. The process of claim 5 in which from about 20 to about 30% by weight of the particulate solid source of heat is in the high velocity stream.

8. The process of claim 1 in which from about 10 to about 50% by weight of the particulate solid source of heat is in the high velocity stream.

9. A process as claimed in claim 1 in which from about 20 to about 30% by weight of the particulate solid source of heat is in the high velocity stream.

10. The process of claim 1 in which the introduction velocity of the high velocity stream of the particulate solid source of heat is greater than about 200 feet per second and up to about 250 feet per second.

11. A process as claimed in claim 1 in which the introduction velocity of the carbonaceous material is from about 100 to about 200 feet per second.

12. The process of claim 1 in which the introduction velocity of the low velocity stream of particulate solid source of heat is from about 100 to about 200 feet per second.

13. The process of claim 1 in which the low velocity, high temperature stream of the particulate solid source of heat is introduced at an angle of from about 15° to about 40° relative to the path of travel of the carbonaceous material.

14. The process of claim 1 in which the low velocity, high temperature stream of the particulate solid source of heat is introduced at an angle of from about 15° to about 25° relative to the path of travel of the carbonaceous material.

15. A process for the pyrolysis of coal comprising the steps of:

a. essentially tangentially introducing to and passing along the path formed by the surface of a cyclone reaction-separation zone having a vapor outlet at one end and a solids outlet at the base thereof, a high velocity, high temperature stream of a particulate solid source of heat containing char, while;

b. introducing into the cyclone reaction-separation zone a stream of coal in a path substantially parallel to the path of travel of the high velocity stream of the particulate solid source of heat, wherein the high velocity stream of the particulate solid source of heat serves to prevent coal from contacting and agglomerating on the inner surface of the cyclone reaction-separation zone, while simultaneously;

c. introducing to the cyclone reaction-separation zone a low velocity, high temperature stream of a particulate solid source of heat containing char, wherein the low velocity stream of the particulate solid source of heat is introduced inclined at an angle of from about 15° to about 40° toward the path of travel of the coal to penetrate and initiate pyrolysis of the coal to yield as products of pyrolysis, in a pyrolysis time of less than about 3 seconds, char and a pyrolytic vapor containing hydrocarbons, wherein the quantity of the particulate solid source of heat is sufficient to yield a weight ratio of the particulate solid source of heat contained in both the high and low velocity streams to the coal of from about 2 to about 8, where from about 50 to about 90% of the particulate source of heat introduced to the cyclone reaction-separation zone is contained in the low velocity stream, and wherein the temperature of the particulate source of heat is sufficient to raise the coal to a pyrolysis temperature of at least about 600° F; and d. separating a gas stream containing pyrolytic vapor from a solids mixture including the particulate solid source of heat and the char formed by the pyrolysis of the coal by the formation of flow patterns of each by action of induced centrifugal forces.

16. The process of claim 15 in which the introduction velocity of the high velocity stream of the particulate solid source of heat is greater than about 200 feet per second and up to about 250 feet per second.

17. A process as claimed in claim 15 in which the introduction velocity of the coal is from about 100 to about 200 feet per second.

18. The process of claim 15 in which the introduction velocity of the low velocity stream of particulate solid source of heat is from about 100 to about 200 feet per second.

19. A process as claimed in claim 15 in which the residence time of the coal in the cyclone reaction-separation zone is from about 0.01 to about 0.5 seconds.

20. A process for the pyrolysis of a carbonaceous material comprising the steps of:

a. essentially tangentially introducing to and passing along the path formed by the surface of a cyclone reaction-separation zone having a vapor outlet at one end and a solids outlet at the base thereof a high velocity, a high temperature stream of a particulate solid source of heat, wherein the stream has an introduction velocity, greater than about 200 feet per second and up to about 250 feet per second;

b. introducing into the cyclone reaction-separation zone a stream of carbonaceous material having a velocity of from about 100 to about 200 feet per second adjacent to and in a path substantially parallel to the introduction path of travel of the high velocity stream of the particulate solid source of heat, wherein the high velocity stream of the particulate solid source of heat prevents the carbonaceous material from contacting the inner surface of the cyclone reaction-separation zone;

c. introducing to the cyclone reaction -separation zone a low velocity, high temperature stream of a particulate solid source of heat having a velocity of from about 100 to about 200 feet per second, wherein the low velocity stream of the particulate solid source of heat is introduced, at an angle inclined at of from about 15° to about 25° to the path of travel of the carbonaceous material to penetrate and initiate pyrolysis of the carbonaceous material to yield as products of pyrolysis, within a pyrolysis time of less than about 3 seconds, a carbon containing solid residue and a pyrolytic vapor containing hydrocarbons, wherein the quantity of the particulate solid source of heat is sufficient to yield a weight ratio of the particulate solid source of heat contained in both the high and low velocity streams to the carbonaceous material of from about 2 to about 20, where from about 70 to about 80% of the particulate solid source of heat introduced to the cyclone reaction-separation zone is contained in the low velocity stream, and wherein the temperature of the particulate source of heat is sufficient to raise the carbonaceous material to a pyrolysis temperature of from about 900° F to about 1400° F, while simultaneously;

d. separating a gas stream containing pyrolytic vapors from a solids mixture including the particulate solid source of heat and the carbon containing solid residue fromed by the pyrolysis of the carbonaceous material by the formation of flow patterns of each by the action of centrifugal forces induced.

21. An apparatus for pyrolysis of a carbonaceous material in the presence of a particulate solid source of heat which comprises a high temperature cyclone separation-reactor having a curved inner surface forming an interior, a first tangential feed inlet directly communicating with the interior for receiving a high velocity stream of a high temperature particulate source of heat for passage along the curved inner surface, a second tangential feed inlet directly communicating with the interior and defining a flow path substantially parallel and adjacent to the flow path defined by the first inlet for introduction of a low velocity stream of carbonaceous material, along a flow path which essentially parallels the flow path of the high velocity stream of high temperature particulate source of heat, whereby the movement of the high temperature and particulate source of heat along the curved inner surface serves to prevent contact of the carbonaceous material with the curved inner surface, and a third feed inlet directly communicating with the interior of the particulate source of heat adjacent to and at an angle inclined to the first and second feed inlets for feed of a low velocity, high temperature stream of the particulate solid source of heat into the path of flow of the carbonaceous material to penetrate and initiate pyrolysis of the carbonaceous material, a vapor exhaust at one end of the cyclone separation-reactor for removal of vaporized products of pyrolysis and a solids outlet at the opposed end thereof and beneath the first, second and third feed inlets for removal of the particulate solid source of heat and carbon containing solid products of pyrolysis.

22. An apparatus as claimed in claim 21 in which the third feed inlet is inclined at an angle of from about 15° to about 40° to the first and second inlets.

23. An apparatus as claimed in claim 21 in which the third feed inlet is inclined at an angle from about 15° to about 25° to the first and second inlets.

* * * * *

UNITED STATES PATENT AND TRADEMARK OFFICE

CERTIFICATE OF CORRECTION

PATENT NO. : 4,070,250

DATED : January 24, 1978

INVENTOR(S) : Charles K. Choi

It is certified that error appears in the above-identified patent and that said Letters Patent are hereby corrected as shown below:

Column 3, line 31, for "aline" read -- line --; line 38, for "material" read -- materials --. Column 5, line 55, for "250°" read -- 250 --. Column 6, line 25, for "of" read -- to --. Column 8, line 39, for "an" read -- at --. Column 10, line 66, for "fromed" read -- formed --.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*